US008425684B2

(12) United States Patent
Hebert

(10) Patent No.: US 8,425,684 B2
(45) Date of Patent: Apr. 23, 2013

(54) CLOSED-LOOP SYSTEM FOR CLEANING VESSELS CONTAINING DRILLING FLUID RESIDUE

(75) Inventor: Paul Hebert, Broussard, LA (US)

(73) Assignee: RCS, LLC, Houma, LA (US)

( * ) Notice: Subject to any disclaimer, the term of this patent is extended or adjusted under 35 U.S.C. 154(b) by 1078 days.

(21) Appl. No.: 11/143,166

(22) Filed: Jun. 2, 2005

(65) Prior Publication Data

US 2007/0246067 A1 Oct. 25, 2007

(51) Int. Cl.
*B08B 7/04* (2006.01)

(52) U.S. Cl.
USPC ..... 134/10; 134/22.1

(58) Field of Classification Search ..... 134/10, 134/13, 22.1, 22.18, 25.1, 26, 33
See application file for complete search history.

(56) References Cited

U.S. PATENT DOCUMENTS

| | | | | | |
|---|---|---|---|---|---|
| 3,856,570 | A | * | 12/1974 | McDermott | 134/24 |
| 3,860,019 | A | | 1/1975 | Teague | |
| 4,175,039 | A | | 11/1979 | Fisher | |
| 5,169,069 | A | | 12/1992 | Rucker et al. | |
| 5,374,352 | A | * | 12/1994 | Pattee | 210/104 |
| 5,620,594 | A | * | 4/1997 | Smith et al. | 210/167.3 |
| 5,740,821 | A | * | 4/1998 | Arnold | 134/113 |
| 5,814,230 | A | * | 9/1998 | Willis et al. | 210/710 |
| 5,908,040 | A | * | 6/1999 | Defraites, Jr. | 134/10 |
| 6,615,849 | B1 | * | 9/2003 | Gilman et al. | 134/22.18 |
| 6,672,388 | B2 | | 1/2004 | McGregor et al. | |
| 2003/0006040 | A1 | | 1/2003 | McGregor et al. | |

* cited by examiner

*Primary Examiner* — Eric Golightly
(74) *Attorney, Agent, or Firm* — John B. Edel; Edel Patents LLC

(57) ABSTRACT

A closed-loop system for cleaning vessels containing drilling fluid residue. High pressure jets of water-based cleaning fluid are used to clean the interior of a vessel. The resulting slurry is sent to one or more solids/liquid separation stages to remove drill cuttings and other drilling fluid solids. The substantially solids-free cleaning fluid discharge is recycled.

5 Claims, 1 Drawing Sheet

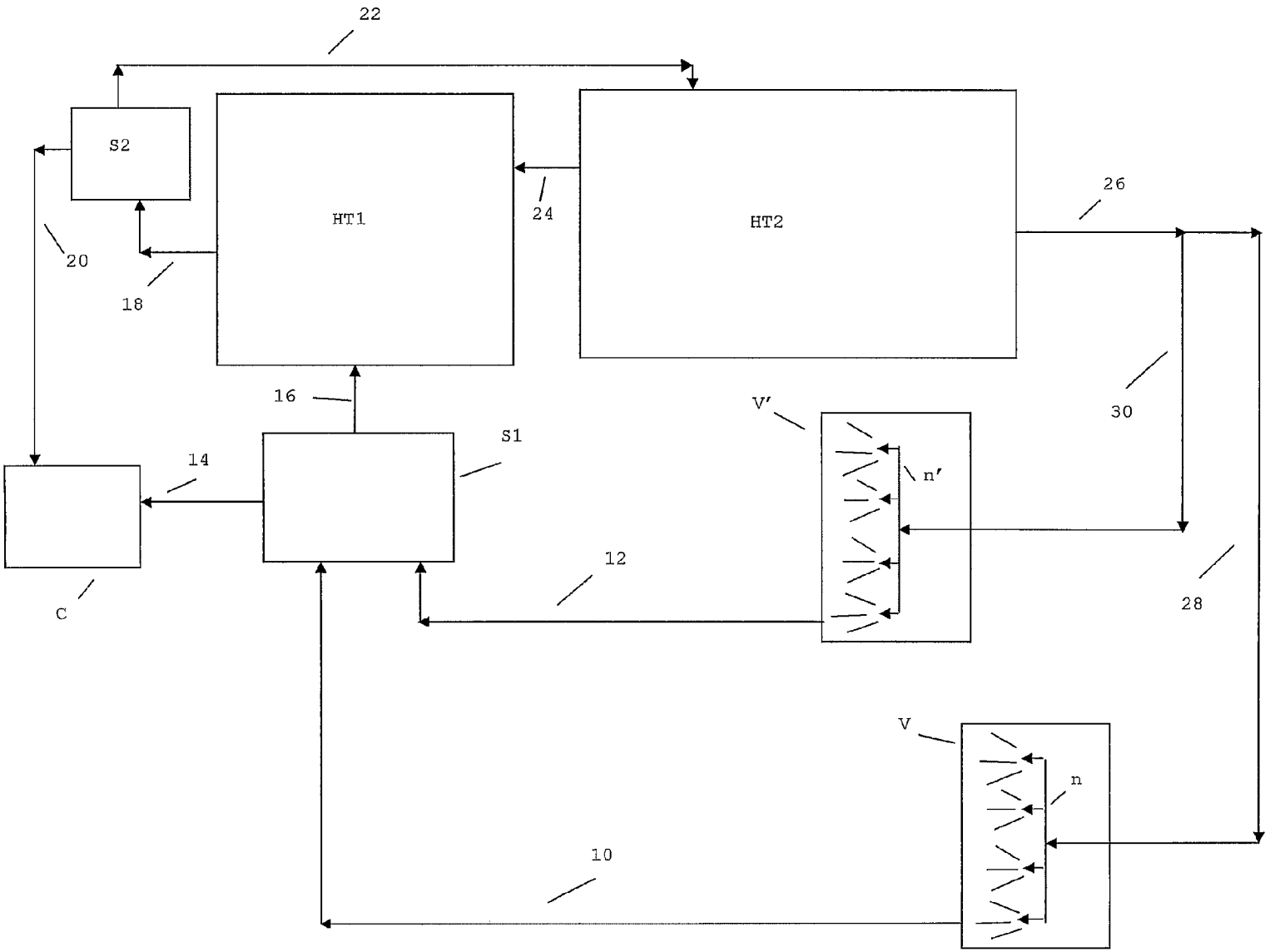
HT2
HT1
S2
S1
C
V
V'
n
n'
10
12
14
16
18
20
22
24
26
28
30

CLOSED-LOOP SYSTEM FOR CLEANING VESSELS CONTAINING DRILLING FLUID RESIDUE

FIELD OF THE INVENTION

The present invention relates to a closed-loop system for cleaning vessels containing drilling fluid residue. High pressure jets of water-based cleaning fluid are used to clean the interior of a vessel. The resulting slurry is sent to one or more solids/liquid separation stages to remove drill cuttings and other drilling fluid solids. The substantially solids-free cleaning fluid discharge is recycled.

BACKGROUND OF THE INVENTION

Drilling fluids, often referred to as drilling muds, play an important role in the drilling of subterranean wells. Such fluids include drilling muds, completion and work over fluids including non-dispersed drilling muds, dispersed drilling muds, calcium treated drilling muds, drilling muds incorporating polymers, drilling muds prepared from fresh or brine, oil-based drilling muds and synthetic drilling muds. Other fluids used in the drilling of oil and gas wells include bactericides, calcium removers, corrosion inhibitors, defoamers, emulsifiers, filtrate reducers, flocculants, foaming agents, lost circulation materials, lubricants, pipe-freeing agents, shale control inhibitors, and surface active agents. A discussion of the various types of drilling, completion and workover fluids used in the oil and gas well drilling industry can be found in the June 1994 issue of "World Oil", which is incorporated herein by reference.

Such fluids are formulated to have specific properties for the required functions and characteristics for their intended purpose. For example, a drilling fluid should circulate throughout the well and carry cuttings from beneath the bit, transport the cuttings up the annulus of the borehole, and allow their separation at the surface. At the same time, the drilling fluid is expected to cool and clean the drill bit, reduce friction between the drill string and the sides of the hole, and maintain stability in the borehole's uncased sections. The drilling fluid should also form a thin, low permeability filter cake that seals openings in formations permeated by the bit and act to reduce the unwanted influx of formation fluids from permeable rock.

Drilling fluids are typically classified according to their base material. In oil based fluids, solid particles are suspended in oil, and water or brine may be emulsified within the oil. The oil is typically the continuous phase. In water based fluids, solid particles are suspended in water or brine, and oil may be emulsified in the water. Water is typically the continuous phase. Pneumatic fluids are a third class of drilling fluids in which a high velocity stream of air or natural gas removes drill cuttings.

Drilling fluids are typically transported and stored in such things as boat tanks, bilges and holds; barges; mobile and land based tanks; cutting boxes or containers; and related vessels (sometimes collectively referred to herein as "vessels"). Such vessels are used to carry different types of drilling fluids and each vessel must be cleaned of the last previous drilling fluid before the next drilling fluid can be introduced. While various procedures are practiced for cleaning such vessels of drilling fluid residue before introducing another, there remains a need in the art for improved and more efficient cleaning operations.

SUMMARY OF THE INVENTION

In accordance with the present invention there is provided a process for cleaning drilling residue from vessels, which process comprises:

a) washing the interior surfaces of one or more vessels containing drilling fluid residue by use of one or more jets of a water- based cleaning fluid from one or more nozzles thereby resulting in a water-based slurry containing solids from the drilling fluid residue;

b) passing the resulting slurry to a first solids/liquid separation zone wherein at least a portion of the solids is separated from the water- based cleaning fluid and resulting in a first separation stage liquid discharge;

c) collecting the separated solids;

d) passing the first stage liquid discharge to a first holding tank wherein at least a portion of any remaining solids is kept suspended in the liquid in the holding tank;

e) passing a portion of the first stage liquid discharge from said first holding tank to a second solids/liquid separation zone wherein substantially all of any remaining solids is separated from the first stage liquid discharge thereby resulting in a second separation stage liquid discharge that is substantially free of solids;

f) passing said substantially solids-free second separation stage discharge from said second solids/liquid separation zone to a second holding tank;

g) passing a first portion of said substantially solids-free second separation stage discharge from said second holding tank to said first holding tank;

h) conducting a second portion of said substantially solids-free liquid discharge from said second holding tank to said one or more nozzles within said one or more vessels being cleaned of drilling fluid residue; and i) repeating steps a) through h) above until said one of more vessels have been cleaned to a predetermined degree.

In a preferred embodiment, the first solids/liquid separation zone comprises a shale shaker for removing the larger size particulates, such as drill cuttings, from the slurry.

In another preferred embodiment, the second solids/liquid separation zone comprises a device that performs the separation by use of centrifugal force.

In yet another preferred embodiment, the substantially solids-free liquid is treated with a flocculating agent to flocculate substantially all remaining solids and entrapped oil.

BRIEF DESCRIPTION OF THE DRAWING

FIG. 1 is a block flow diagram representing an embodiment of the invention.

DETAILED DESCRIPTION OF THE INVENTION

Any type of vessel or container that is used for the transportation and/or storage of drilling fluids can be cleaned in accordance with the present invention. Such vessels include, but are not limited to, boat tanks, bilges and holds; barges; mobile and land based tanks; cutting boxes or containers; and related vessels (all generically referred to herein as "vessels"). The cleaning system of the present invention is a closed loop system, preferably an automated closed loop system. By "closed loop" we mean that the water-based cleaning fluid used to clean the interior walls of the vessel(s) is treated to remove particulates and recycled to the nozzle apparatus within the vessel(s). By automated we mean the use of a controlled spraying (nozzle) apparatus that is pre-programmed to cover a predetermined area, preferably the entire inside surfaces, of the vessel to be cleaned. One preferred nozzle apparatus uses the water-based cleaning fluid to be sprayed within the vessel to drive a nozzle spray assembly of the spraying apparatus in a predetermined pattern. Such an apparatus typically includes a primary drive shaft that is usually driven by a turbine powered by the fluid flowing through the device. The primary drive shaft is connected to a gear train that is located in a separate compartment that is sealed from the remaining portion of the apparatus.

The nozzle apparatus is movable in response to jet reaction forces of cleaning jet streams of fluid to provide a three-dimensional scanning pattern of the jet streams to clean the interior wall surfaces of the vessel by the impingement on the walls, the jet streams under high pressure for removing deposits on the wall surfaces. Nozzles that direct the jet streams are preferably angularly adjustable and indexed together to allow selection of an appropriate torque or couple based upon volume and pressure of fluid flow while insuring that the high pressure jet reaction forces are always balanced. That is, when two nozzles are used, the forces are essentially equal and opposite along parallel lines.

It is preferred that the nozzle apparatus be of such small size as to be inserted into the hollow vessels to be cleaned through relatively small openings and hung, pulled or otherwise supported and moved therein to enable jet stream cleaning of the entire inner surfaces of the vessel, particularly corners and other hard to reach areas. Such an apparatus is provided with a suitable hose(s) connected thereto with sufficient volume of cleaning fluid under high pressure and in multiple streams that are preferably automatically redirected in overlapping three-dimensional patterns to clean the entire interior walls and other exposed interior surfaces of the vessels. It is within the scope of this invention that the nozzle apparatus be controlled by a computer and suitable software. Non-limiting examples of spraying or nozzle apparatus can be found in U.S. Pat. Nos. 5,169,069 and 5,947,387 both of which are incorporated herein by reference.

The present invention can better be understood with reference to the Figure hereof. Ancillary equipment, such as valves, switches, power sources, and compressors, are not presented in this figure for the sake of clarity. The figure hereof shows two vessels V and V' to be cleaned of drilling fluid residue. Each vessel, V and V' contains a nozzle apparatus comprised of one or more nozzles with appropriate hoses n and n' respectively through which a high pressure jet of water-based cleaning fluid is projected by use of one or more suitable pumps (not shown). The water-based liquid is one of any suitable composition for cleaning vessels of drilling fluid residue. Typically, the water-based cleaning fluid will be one that is compatible with the particular drilling fluid residue being cleaned from the vessel. Such a cleaning fluid will contain an effective amount of one or more suitable additives, such as surfactants, defoamers, viscosity modifiers etc. The particular surfactant employed will be one that is compatible with the surfactants of the drilling fluid. Such surfactants can be cationic, anionic, nonionic, or hydrotropic surfactants. This results in a slurry of the water-based cleaning fluid and solids from the drilling fluid. Solids from the drilling fluid can range in size from relatively coarse particles that would include drill cuttings to relatively fine particles that include such things as finer drill cuttings, clay and additive particles, such as barite, bentonite, sand and any other particles suitable for use herein, preferably naturally occurring minerals.

The resulting slurry is passed via lines 10 and 12 from vessels V and V' respectively to a first solids/liquid separation zone S1 wherein relatively coarse particulates are removed. By relatively coarse particulates we mean having an average particle size greater than about 60 micron, preferably greater than about 70 microns, and more preferably greater than about 75 microns. Although any suitable solids/liquid separation device can be used as long as it is capable of separating solids from the liquid phase in the desired solids particle size range and at an effective flow rate. Preferred devices are those containing screens that pass-thru the liquid but retain solids in the desired size range. More preferred are the so-called shale shakers that are conventionally used in the drilling fluid art to remove drill cuttings from drilling fluid. Such devices typically contain a plurality of wire-cloth screens having suitable openings, which screens vibrate while the drilling fluid flows on top of it. The liquid phase and solids smaller than the wire mesh pass through the screen, while larger particles are retained on the screen and eventually fall off one end as shown by line 14 and are collected for discard in container C. Of course, smaller openings in the screen will clean more solids from the slurry, but there will be a corresponding decrease in flow rate per unit area of wire cloth. It is within the scope of this invention to use multiple solid/liquid separation devices in series with each immediate downstream device retaining smaller particles than the immediate upstream device. Shakers suitable for use in the practice of this invention are available from such companies as Kem-Tron Technologies and Gann Mekaniske A-S.

The liquid, or filtrate phase, from first separation zone S1 is passed via line 16 to first holding tank HT1 wherein solids are kept suspended in the liquid. A stream of liquid is passed from holding tank HT1 via line 18 to second solids/separation zone S2 which is capable of separating finer particles from the liquid compared with that of solids/liquid separation zone S1. Although it is preferred that substantially all of the remaining solids be removed in this second zone S2, for practical purposes a small amount of very fine particles will remain in the liquid. These finer particles, along with entrained oil, can be separated downstream by use of a flocculating agent between cleaning applications. Any device suitable for separating fine particles in suspension can be used for S1. One preferred type of device is a device that performs the separation by centrifugal force, preferably a solid-liquid hydrocyclone. Solid/liquid hydrocyclones are well known in the art and are cyclone clarifiers that offer continuous solids removal from a liquid. They are typically used in industrial process water, industrial reuse, oil/water separation and clarification/separation applications. It is within the scope of this invention that only one separation zone be used and that it contain a solid-liquid separation device that performs the separation by centrifugal force. Solids that are separated in second separation zone S2 are collected are passed via line 20 to container C for discard. The resulting substantially solids-free liquid is passed via line 22 to second holding tank HT2. A stream of liquid from second holding tank HT2 is passed via line 24 to first holding tank HT1. Holding tanks HT1 and HT2 can be separate vessels or they can be part of a single vessel separated by a common wall. It is preferred that they be two separate compartments in a single vessel and it is also preferred that liquid be passed from holding tank HT2 to HT1 by overflow over a weir (not shown) located at the top of a separating wall (not shown).

A stream of substantially solids-free liquid is passed via line 26 to lines 28 and 30 as feed to the nozzle apparatus n and n' for continued cleaning of vessels V and V'. Use of the present invention allows for the safe and efficient cleaning of various types of vessels containing drilling fluid residue. The liquid is conducted from, and to, the various stages and zones of the present invention by use of suitable conventional pumps (not shown) and at flow rates that will maintain the overall system in proper liquid balance. Make-up water, with or without additives, can be added at any suitable point in the system, but it is preferably added at second holding tank HT2 or into line 26 for feeding nozzle assemblies n and n'.

Prior to any cleaning using the system of the present invention the cleaning fluid is preferably prepared by blending with water, a cleaning pill of suitable composition in an effective amount. A suitable amount for the system shown herein is about 300 barrels. The preferred pill will be comprised of a mixture of proprietary surfactants and other chemicals mixed with fresh water at predetermined concentrations that are compatible with the drilling fluid residue to be cleaned from the vessel. This fluid will be used over and over on several jobs until the fluid becomes spent. That is, it will become saturated with hydrated solids that can not be separated using the conventional solids/liquid equipment used herein; saturated with emulsified oil; or the surfactant itself will become spent. At this point, the fluid will either be chemically treated, passed through the solids/liquid separation equipment and the chemicals reintroduced or disposed of. If the fluid is disposed of, a fresh batch of cleaning liquid will be made.

What is claimed is:

1. A process for cleaning drilling residue from vessels, which process comprises:

a) washing the interior surfaces of a first dirty vessel containing drilling fluid residue by use of two or more jets of a water-based cleaning fluid from two or more nozzles that are automated to cover substantially the entire inside surface of said first dirty vessel with the two or more jets of the water-based cleaning fluid thereby resulting in a water-based slurry containing particulates ranging in size from coarse particulates to fine particulates from the drilling fluid residue;

b) passing the water based slurry to a first particulates/liquid separation zone wherein at least a portion of the particulates is separated from the water-based cleaning fluid and resulting in a first separation stage liquid discharge;

c) collecting the portion of the particulates;

d) passing the first separation stage liquid discharge to a first holding tank wherein at least a portion of any remaining particulates is kept suspended in the liquid in the first holding tank;

e) passing a portion of the first separation stage liquid discharge from said first holding tank to a second particulates/liquid separation zone wherein substantially all of any fine particulates remaining in the portion of the first separation stage liquid discharge are separated from the portion of the first separation stage liquid discharge thereby resulting in a second separation stage liquid discharge that is substantially free of particulates;

f) passing substantially all of the second separation stage liquid discharge from said second particulates/liquid separation zone to a second holding tank having a second holding tank contents;

g) transferring a first portion of the second holding tank contents to the first holding tank;

h) transferring a second portion of the second holding tank contents to the two or more nozzles thereby creating a closed loop system;

i) repeating steps a) through h) above until said first dirty vessel has been cleaned;

j) moving the two or more nozzles to a second dirty vessel k) wherein the first particulates/liquid separation zone comprises a shale shaker apparatus for removing coarse particulates having an average particle size of greater than about 60 microns;

l) wherein the second particulates/liquid separation zone comprises a device that performs the separation by use of centrifugal force;

m) wherein the water based cleaning fluid is treated with a flocculating agent;

n) wherein said first holding tank and said second holding tank consist essentially of a single holding vessel and a weir; and o) wherein the transferring of the first portion of the second holding tank contents to the first holding tank is by overflow over said weir.

2. The process of claim 1 wherein the first dirty vessel comprises comprise a ship's hold.

3. The process of claim 1 wherein the first dirty vessel comprises a land based tank.

4. The process of claim 1 wherein the device that performs the separation by use of centrifugal force is an assembly of hydrocyclones.

5. The process of claim 1 wherein the water based cleaning fluid contains a surfactant.

* * * * *